United States Patent [19]

Schenk

[11] 4,049,301

[45] Sept. 20, 1977

[54] TOGGLE LATCH

[75] Inventor: Peter Schenk, West Islip, N.Y.

[73] Assignee: Dzus Fastener Co., Inc., West Islip, N.Y.

[21] Appl. No.: 639,422

[22] Filed: Dec. 10, 1975

Related U.S. Application Data

[63] Continuation of Ser. No. 480,391, June 18, 1974, abandoned.

[51] Int. Cl.[2] ..... E05C 19/14

[52] U.S. Cl. ..... 292/113; 292/66; 292/DIG. 49; 24/68 R; 24/68 T

[58] Field of Search ..... 292/113, 114, 66, 67, 292/247, DIG. 49, DIG. 31; 16/147; 24/68 R, 68 T

[56] References Cited

U.S. PATENT DOCUMENTS

| | | | |
|---|---|---|---|
| 1,006,347 | 10/1911 | Belsvig | 292/113 |
| 2,472,285 | 6/1949 | Claud-Mantle | 292/147 |
| 3,193,314 | 7/1965 | Johnson | 292/113 |
| 3,259,411 | 7/1966 | Griffiths | 292/113 |

*Primary Examiner*—Robert L. Wolfe
*Attorney, Agent, or Firm*—Kane, Dalsimer, Kane, Sullivan & Kurucz

[57] ABSTRACT

A toggle latch for joining together two members. The latch includes a fixed engageable keeper element adapted to be secured to one of the members and a lever assembly adapted to be secured to the other member. The lever assembly includes a bracket, an operating lever secured to the bracket by a fixed pivot and an intermediate portion of the lever, and a drawbar secured to one end of the lever beyond the fixed pivot by means of a movable pivot. The opposite end of the lever forms a handle. The movable pivot is positioned relative to the fixed pivot so that when the drawbar is engaged with the keeper and the handle is shifted to the latched position the movable pivot will be shifted around and into a latched position behind the fixed pivot. Finally, spring means is on the lever assembly to facilitate engagement of the drawbar and the keeper element, and shifting of the lever assembly to the latched position where the members are maintained in tight joined condition.

5 Claims, 3 Drawing Figures

TOGGLE LATCH

This is a continuation of application Ser. No. 480,391, filed June 18, 1974, and now abandoned.

BACKGROUND OF THE INVENTION

Toggle latches have evolved over many years. Individual design fasteners have derived from the constantly developed improvements, such as toggle latches generally known as the under-center type. This type of latch has been disclosed recently in U.S. Pat. No. 3,127,205. The general configuration of this type of latch makes it adaptable for use in more confined areas since it requires less space to work in than the typical type of over-center toggle latches.

In general, whether the latch is over-center or under-center in operation, the latching action is achieved through an interengagement between a drawbar and a keeper element and then shifting of a lever to move the interpivoted drawbar axially into tight interengagement with the keeper element. During the action of latching the movable pivot connecting the lever arm with the toggle bar is shifted to a position where it is over or under-center with respect to a fixed pivot so that any tendency to move the drawbar toward the keeper element is restricted by the mounting of the assembly in combination with the over or under-center movable pivot position whereby the drawbar tends to restrict itself from axial movement to the unlatched position.

In general, there is minimal tolerance permitted between the interengaging elements of the toggle latch. If the drawbar and interconnected lever assembly is not properly positioned with respect to the keeper element, the latching action could be incomplete if they are spaced incorrectly in one direction or impossible if they are spaced incorrectly in an opposite direction. Consequently, various improvements have been derived which permit adjustment of the toggle latch assembly and the keeper element so that the proper latching action can occur. In many cases these improvements are cumbersome and time-consuming to operate and their complexity often leads to an expensive and inefficient product to manufacture. In fact, in view of the complexity of the varied components of the assembly, an improvement regarding simplicity of construction would be advantageous from a cost standpoint.

It should also be kept in mind that while wide tolerances are desirable for mass production and operation of the toggle latches, it is imperative that the latch be positive and rigid in its locking action so that the members interengaged are retained in tight interengagement during use. Consequently, loose fits or components having wide tolerances could detract from positive locking action and result in a less than desirable latching action.

In conclusion, as has been exemplified by the development of the state of the art over many years, constant improvement and development continues in order to improve the versatility of available types of toggle latches as well as improving their simplicity of operation to minimize the space required for mounting and use of the latches to lower the cost of construction thereby providing a more economic latch, and to increase the workable tolerances of the resultant product while retaining the rigid positive latching effect. Of course, it is also valuable to maintain the strength of the latch at the most desirable level to enhance its areas of applicability.

SUMMARY OF THE INVENTION

With the above background in mind, it is among the primary objectives of the present invention to provide a toggle latch which is of lower cost and more economical to produce and use than any known structures presently in the marketplace. A latch is provided with increased strength when in the locked position and with the ability to accommodate variations in dimensional criteria for mounting an assembly of the latch while retaining a positive locking action at all times.

In summary, a toggle latch is provided for joining together two members. The latch includes a fixed engageable keeper element adapted to be secured to one of the members and a lever assembly adapted to be secured to the other member. The lever assembly includes a bracket, an operating lever secured to the bracket by a fixed pivot and an intermediate portion of the lever, and a drawbar secured to one end of the lever beyond the fixed pivot by means of a movable pivot. The opposite end of the lever forms a handle. The movable pivot is positioned relative to the fixed pivot so that when the drawbar is engaged with the keeper and the handle is shifted to the latched position the movable pivot will be shifted around and into a latched position behind the fixed pivot. Spring means is on the lever assembly to facilitate engagement of the drawbar and the keeper element, and shifting of the lever assembly to the latched position where the members are maintained in tight joined condition.

With the above objectives in mind, reference is had to the attached drawings.

DESCRIPTION OF THE PREFERRED EMBODIMENT

Figure 1:
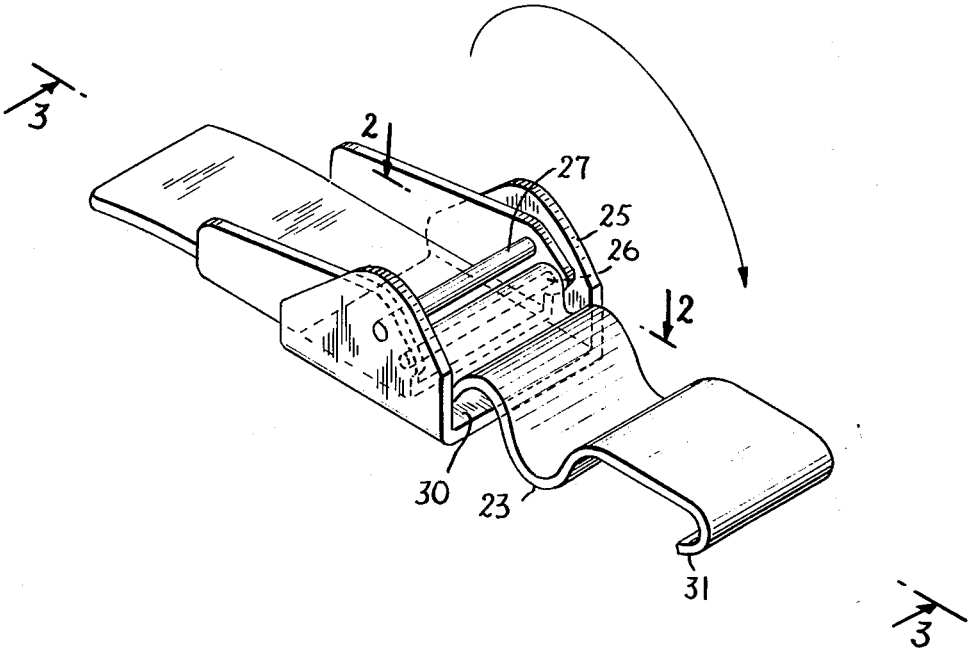
FIG. 1 is a perspective view of the lever assembly portion of the toggle latch of the invention shown in the unlatched condition.
Figure 2:
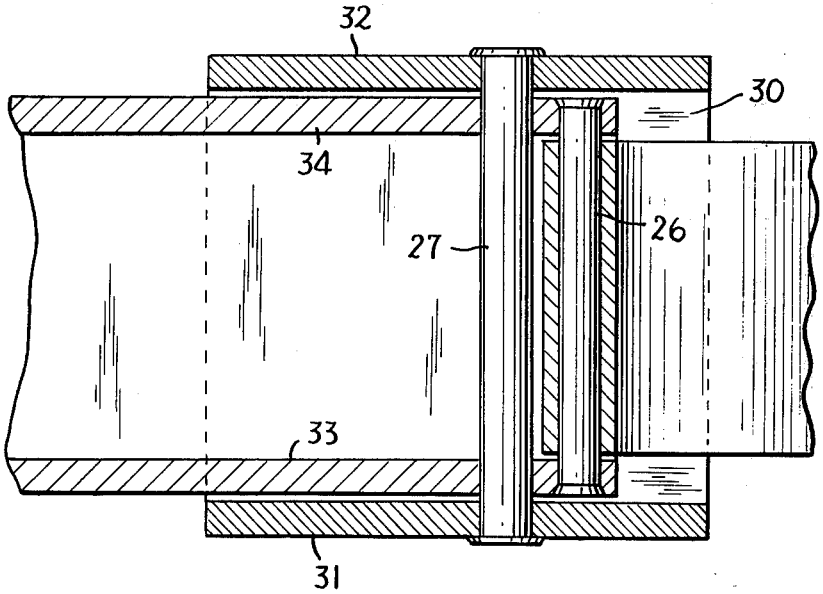
FIG. 2 is a fragmentary sectional plan view thereof.
Figure 3:
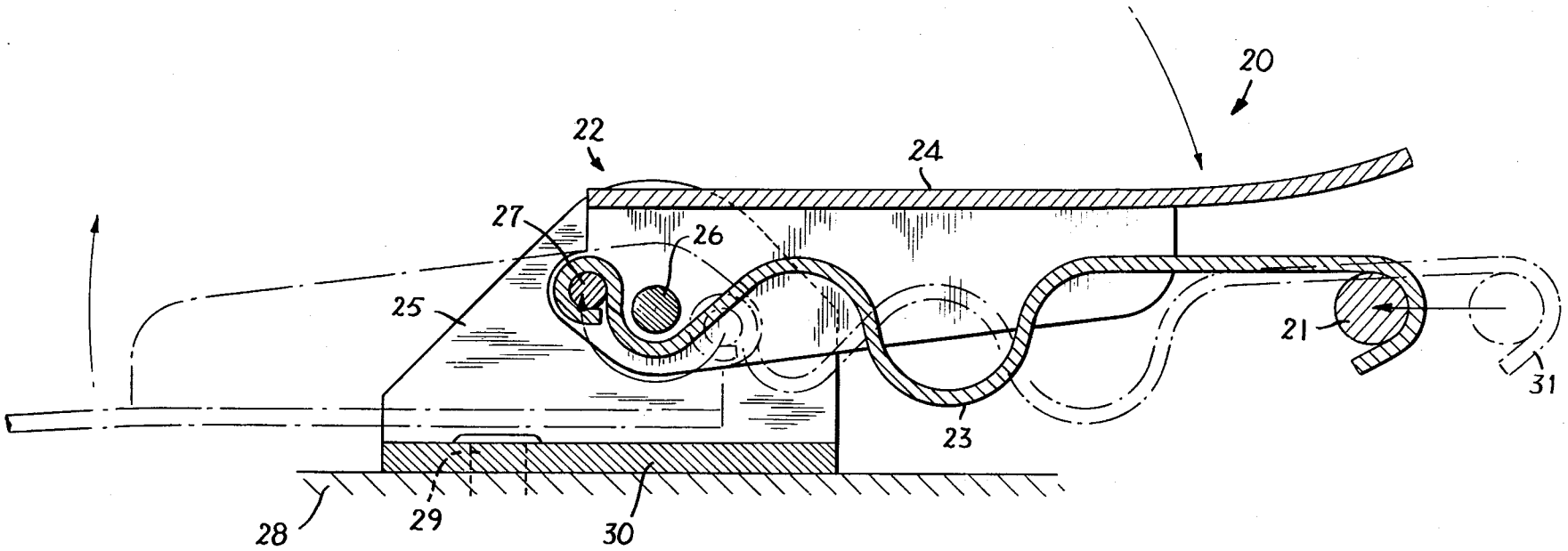
FIG. 3 is a sectional elevation view of the toggle latch of the invention in latched condition with the latch shown in phantom in the unlatched condition.

Toggle latch 20 is shown in assembled condition in FIG. 3 of the drawings. Latch 20 can be constructed of any conventional well known material such as plastic or a metal, for example, steel. The keeper element 21 which may be a cylindrical bar as shown is mounted on one of the members to be fastened (not shown). It can be mounted in any conventional fashion and it is positioned in a permanent rigid location. The remainder of the latch is an integral lever assembly 22. Drawbar 23, operating lever 24 and bracket 25 are interconnected to form lever assembly 22. The necessary attachments are achieved by means of a fixed pivot 26 and a movable pivot 27. Bracket 25 is mounted to member 28 which is to be fastened to the member on which keeper 21 is located. This may be accomplished in any convenient fashion such as by rivets or screws 29 passed through the base 30 of bracket 25 and then into member 28.

Bracket 25 includes a flat base portion 30 and a pair of spaced upstanding sides 31 and 32. Operating lever 24 has a pair of opposing skirts 33 and 34 which are substantially parallel to and located just inside of sides 31 and 32 of bracket 25. The operating lever 24 is mounted to bracket 25 by means of fixed pivot 26 which is formed by a cylindrical pin or rivet extending through sides 31 and 32 of the bracket and 33 and 34 of the operating lever. Pin 26 can be a rivet or a screw or a bolt or any similar element that can be easily positioned through the sides of the bracket and the skirts of the lever. Pin 26 which forms the fixed pivot is located adjacent to one end of the lever and is spaced above base 30 of the bracket so as to permit clearance for rotation of the lever betwen the unlatched position shown in phantom in FIG. 3 and the latched position as shown. The arrow in FIG. 3 depictes the rotational movement of the operating lever as it pivots about fixed pivot 26 between the unlatched position and the latched position.

One end of the drawbar 23 is formed into a loop through which the movable pivot in the form of a cylindrical pin 27 is passed. The ends of pin 27 are fastened to skirts 33 and 34 of the operating lever 24 in a conventional fashion such as by riveting. This interconnection between lever 24 and drawbar 23 permits relative movement between those two elements subject to movement of pivotal pin 27.

In the unlatched position as shown in phantom, pin 27 is forward of and below fixed pivot 26. Movement of operating lever 24 into the latched position moves drawbar 23 axially backward as shown by the arrow in FIG. 3 while simultaneously rotating movable pivotal pin 27 below and around fixed pin 26 to a position behind and above pin 26. An arrow is present on FIG. 3 to show this path of movement of pin 27. As shown, the clearance between fixed pivotal pin 26 and base 30 of bracket 25 is sufficient to permit movement of the drawbar and the movable pivot from a position forward of and substantially below the fixed pin, around and under fixed pin 26, to a position behind and substantially above fixed pin 26. This action places the movable pivot 27, in the latched position with operating lever 24 fully closed as depicted in FIG. 3, in a position to assist in resisting axial tension forces on drawbar 23 which might tend to pull the lever assembly and the keeper element apart. In this manner, the latching effect is facilitated and tight rigid interengagement is maintained between the lever assembly and the keeper element and consequently member 28 and the member to which the keeper element is attached.

As shown, drawbar 23 is of a corrugated configuration thereby causing the normally rigid drawbar member 23 to contain some resiliency and play so that it acts as a spring member. In this manner, the drawbar will be adaptable for interengagement with keeper elements 21 which are not necessarily positioned in an accurate location with respect to the lever assembly. Furthermore, when the latch is closed, the springy nature of drawbar 23 will facilitate closing of the latch with respect to a keeper element which may not be necessarily in the same location every time. The difference in dimension or tolerance would be taken up by the corrugated spring-like drawbar 23. On the other hand, the drawbar is essentially a rigid member as are all other members of latch 20 so that the tight rigid locking interengagement between the members being fastened is maintained. It has been found that a latch of spring steel has been found to work effectively for the embodiment shown. Naturally, the number of corrugations and the particular configuration of the spring-like drawbar 23 is a matter of choice and environment. The drawbar can be made more or less springy depending upon its use and location.

Another feature which is of significance in regard to drawbar 23 is that its first full corrugation 29 is shifted with movable pivot 27 into a latched position where it partially surrounds fixed pin 26. In this fashion, corrugation 29 forms an additional retention surface against axial tension force applied to the latch and thereby assists in retaining the latch in position to hold the members being fastened together.

The economy of the structure is readily apparent in that the spring member is built into the drawbar element thereby providing a spring action without the necessity of an additional part. Furthermore, an additional supporting surface is provided by having the first corrugation 29 in partially surrounding relation with respect to fixed pin 26 in the latched position without the necessity of additional structure. Also, fixed pin 26 can take the form of a common rivet or similar fastening device as shown which can be inexpensively manufactured and assembled to the remaining components to form the lever assembly. The saving in costs and the resultant versatility of the structure is readily apparent.

In operation, lever assembly 22 is mounted to member 28 and keeper element 21 is mounted to the other member to be fastened together. A degree of tolerance is permitted without the necessity of adjustment of various positions of members of the assembly prior to use. In this respect, the present latch 20 is self-adjusting. Operating lever 24 is shifted to the fully unlatched position thereby causing movable pivot 27 to shift forward of fixed pivot 26 and axially extend drawbar 23 into position for engagement with keeper element 21. This engagement is accomplished by means of hooked end 31 on drawbar 23 which extends around and engages with keeper element 21.

Operating lever 24 is then rotated as shown by the arrow in FIG. 3 to the latched position which through movement of movable pivot 27 axially draws drawbar and engaged keeper 21 toward member 28. The movable pivot 27 travels below and around pin 26 until it reaches a position above the center of pin 26 and behind pin 26. Simultaneously, this brings first corrugation 29 of drawbar 23 into a partial surrounding position with respect to pin 26 so as to provide another engagement surface against axial tension forces attempting to separate the latched members.

Corrugated spring-like drawbar 23 accommodates variations in dimensional distances between the keeper and lever assembly by its inherent spring-like nature. With tension forces acting on the drawbar intending to draw the latched members apart, the spring-like drawbar tends to return to the relaxed configuration and consequently acts in more tightly and rigidly holding the latched members together. The simplicity and low cost construction of toggle latch 20 is readily apparent as are the built in features described above to provide a more effective and positive acting latch.

Unlatching can be readily accomplished by merely rotating operating lever 24 from the latched position rearwardly to the unlatched position thereby permitting movable pivot 27 to move under and forward of fixed pivot pin 26 and simultaneously axially shifting drawbar 23 forward to a position where it becomes disengaged from keeper 21 thereby permitting separation of the latched members. By providing a fixed pivot 26 which extends entirely through the walls 31 and 32 of the bracket and the skirts 33 and 34 of the lever, an inexpensive, yet strong structure is achieved. The spring integrally incorporated in drawbar 23 can be of any desired configuration depending upon the environment. By incorporating the present structure in the under pivot design rather than an over pivot design for the toggle latch, a more compact device is provided which requires less space for mounting and use.

Thus, the above objectives of the present invention, among others, are effectively attained.

What is claimed is:

1. A toggle latch for joining together two members comprising:

a fixed engageable keeper element adapted to be secured to one of the members;

a lever assembly adapted to be secured to the other member;

said lever assembly including a bracket, an operating lever secured to the bracket by a fixed pivot at an intermediate portion of the lever and a drawbar secured to one end of the lever beyond the fixed pivot by means of a movable pivot;

the opposite end of the lever forming a handle;

the movable pivot being positioned relative to the fixed pivot so that when the drawbar is engaged with the keeper and the handle is shifted to the latched position the movable pivot and portion of the drawbar connected and adjacent thereto will be shifted around and into a latched position behind and above the fixed pivot with the remainder of the drawbar extending outwardly from the underside of the fixed pivot and the drawbar being substantially obscured from view by the handle and lever;

spring means on the lever assembly to facilitate engagement of the drawbar and the keeper element and shifting of the lever assembly to the latched position where the members are maintained in tight joined condition;

the spring means being in the drawbar which is a substantially rigid member and is corrugated to provide sufficient resilience for the necessary axial play required to assure proper engagement between the drawbar and the keeper element and latching of the assembly;

one of the corrugations in the drawbar being positioned so that when the assembly is in the latched position the one corrugation will partially surround the fixed pivot in relatively close proximity thereto and provide additional support for the latch in the latched position by being in position to quickly engage the fixed pivot upon an excess of tension applied to the drawbar; and the corrugations being shallow and the fixed pivot being positioned with a minimum clearance between the underside of the fixed pivot and the base of the bracket and the one corrugation can pass therebetween so as to form a compact toggle latch with a pleasing visual appearance.

2. A toggle latch for joining together two members comprising:

a fixed engageable keeper element adapted to be secured to one of the members;

a lever assembly adapted to be secured to the other member;

said lever assembly including a bracket, an operating lever secured to the bracket by a fixed pivot at an intermediate portion of the lever and a drawbar secured to one end of the lever beyond the fixed pivot by means of movable pivot;

the opposite end of the lever forming a handle;

the movable pivot being positioned relative to the fixed pivot so that when the drawbar is engaged with the keeper and the handle is shifted to the latched position the movable pivot and portion of the drawbar connected and adjacent thereto will be shifted around and into a latched position behind and above the fixed pivot with the remainder of the drawbar extending outwardly from the underside of the fixed pivot and the drawbar being substantially obsecured from view by the handle and lever;

spring means on the lever assembly to facilitate engagement of the drawbar and the keeper element and shifting of the lever assembly to the latched position where the members are maintained in tight joined condition;

the bracket including a base and two opposed upstanding sides, the lever assembly mounted within the opposing upstanding sides, and the fixed pivot being a continuous pin extending through the lever assembly and through the opposed upstanding sides of the bracket;

the spring means being in the drawbar which is a substantially rigid member and is corrugated to provide sufficient resilience for the necessary axial play required to assure proper engagement between the drawbar and the keeper element and latching of the assembly;

one of the corrugations in the drawbar being positioned so that when the assembly is in the latched position the one corrugation will partially surround the fixed pivot in relatively close proximity thereto and provide additional support for the latch in the latched position by being in position to quickly engage the fixed pivot upon an excess of tension applied to the drawbar; and the corrugations being shallow and the fixed pivot being positioned with a minimum clearance between the underside of the fixed pivot and the base of the bracket and the one corrugation can pass therebetween so as to form a compact toggle latch with a pleasing visual appearance.

3. The invention in accordance with claim 1 wherein the lever assembly is of a spring steel material.

4. The invention in accordance with claim 1 wherein the drawbar has a hooked free end to facilitate engagement with the keeper element.

5. The invention in accordance with claim 1 wherein the movable pivot includes a pin extending transversely through the drawbar and into a pair of opposed depending skirts on the lever assembly handle thereby interconnecting the drawbar with the lever assembly handle.

* * * * *